US005992566A

United States Patent [19]

Yeh

[11] Patent Number: 5,992,566

[45] Date of Patent: Nov. 30, 1999

[54] PULLING DEVICE FOR FOLDABLE LADDER JOINT

[76] Inventor: Chin-Wen Yeh, 10-2, Hsinlung Street, Nuan-nuan, Keelung, Taiwan

[21] Appl. No.: 09/069,638

[22] Filed: Apr. 30, 1998

[30] Foreign Application Priority Data

Jan. 22, 1998 [DE] Germany ..... 298 01 045 U

[51] Int. Cl.[6] ..... E06C 1/00

[52] U.S. Cl. ..... 182/163; 16/329; 16/332; 403/92

[58] Field of Search ..... 182/22, 23, 24, 182/163, 164; 16/329, 330, 331, 332, 334; 403/91, 92, 93, 94, 95, 96, 97, 98, 99

[56] References Cited

U.S. PATENT DOCUMENTS

| | | | |
|---|---|---|---|
| 4,566,150 | 1/1986 | Boothe | 182/163 X |
| 4,577,986 | 3/1986 | Wang | 182/163 X |
| 4,602,889 | 7/1986 | Mu-Shan | 182/163 X |
| 4,666,328 | 5/1987 | Ryu | 182/163 X |
| 4,770,559 | 9/1988 | Yoo | 403/93 |
| 4,824,278 | 4/1989 | Chang | 182/163 X |
| 5,026,198 | 6/1991 | Lin | 182/163 X |
| 5,620,272 | 4/1997 | Sheng | 182/163 X |

*Primary Examiner*—DAniel P. Stodola
*Assistant Examiner*—Richard M. Smith
*Attorney, Agent, or Firm*—Connolly, Buve, Lodge & Hutz LLP

[57] ABSTRACT

A pulling device for a foldable ladder joint, comprising: two inner bodies, having facing front surfaces, with aligned sets of three arc-shaped holes each along a circular path; an arc-shaped piece, inserted between the front surfaces of the two inner bodies, extended along the circular path and glidingly movable along the circular path, guided by pins or projections, which extend into the arc-shaped holes of the inner bodies; and a spring with two ends, which are held on a fixed position on one of the inner bodies and one end of the arc-shaped piece, so as to exert an elastic force on the arc-shaped piece along the circular path.

2 Claims, 4 Drawing Sheets

PULLING DEVICE FOR FOLDABLE LADDER JOINT

BACKGROUND OF THE INVENTION

1. Field of the Invention

The present invention is related to a pulling device in a joint of a foldable ladder, particularly to a pulling device of simplified structure and improved operation.

2. Description of Related Art

A joint for a foldable ladder has been disclosed in the German Utility Model No. 29600583,5. Therein, as shown in FIG. 5, three gliding pins 8 are each connected with a spring 9 to form three pulling devices. A handle 7 allows to vary the opening angle of the foldable ladder between three different adjustments. This arrangement has few structural parts and thus works reliably.

The main characteristic of the present invention is that a single spring is substituted for the three springs 9. An arc-shaped part connects the three gliding pins 8, forming a single pulling device. The handle 7 for unlocking the joint, when operated, is exposed to an elastic force from the pulling device. Since the three gliding pins 8 are connected by the arc-shaped part, they will be moved along a circular line. Thus reliable functioning of the pulling device is ensured. At the same time, the number of structural parts is reduced.

The present invention can be more fully understood by reference to the following description and accompanying drawings.

DETAILED DESCRIPTION OF THE PREFERRED EMBODIMENTS

Figure 5:
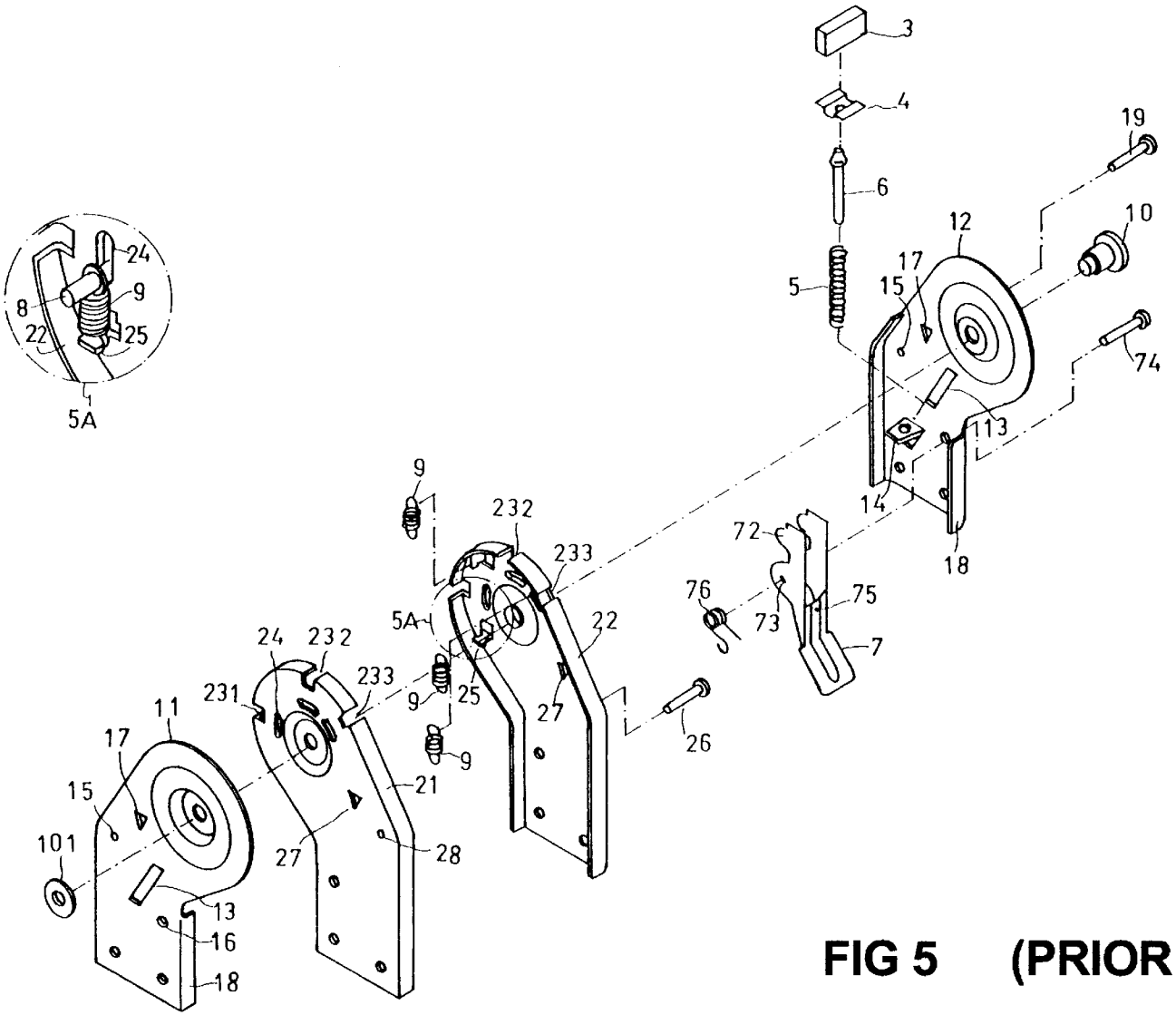
FIG 5 (PRIOR ART)
FIG. 5 is an exploded perspective view of a conventional pulling device for a foldable ladder joint, as disclosed in German Utility Model No. 29600583,5.

As shown in FIG. 5, the conventional pulling device for a foldable ladder joint, as disclosed in German Utility Model No. 29600583,5, mainly comprises: two inner bodies 21, 22, each having a front surface and a periphery, with the front surfaces facing each other; two outer bodies 11, 12, respectively connected with the inner bodies 11, 12; a holding device, having a gliding piece 3, a washer 4, a spring 5and a holding pin 6; three gliding pins 8, glidingly movable along the periphery of the inner bodies 21, 22; three springs 9, together with the gliding pins 8 forming a pulling device; and a handle 7. Three accommodating grooves 231, 232, 233 are cut into the peripheries of each of the inner bodies 21, 22. By placing the gliding piece 3 in one of the accommodating grooves 231, 232, 233, any movement of the outer bodies 21, 22 against the inner bodies 21, 22 is blocked, such that the foldable ladder has a fixed opening angle. By operating the handle 7, the gliding piece 3 is caused to leave the previously occupied accommodating groove of the accommodating grooves 231, 232, 233, allowing to change the opening angle of the foldable ladder. The inner body 21 has three arc-shaped holes 24, and the inner body 22 has three arc-shaped holes 24, which are respectively aligned with the arc-shaped holes 24 of the inner body 21. One of the gliding pins 8 passes through every pair of aligned arc-shaped holes 24. Since the arc-shaped holes are extended along the peripheries of the inner bodies 21, 22, the gliding pins 8 are allowed to move along the peripheries thereof. Each of the gliding pins 8 is pulled by one of the springs 9 towards a fixed position on the inner body 22. When, after operating the handle 7, the gliding piece 3 leaves the previously occupied accommodating groove of the accommodating grooves 231, 232, 233, the handle 7 is exposed to an elastic force of the pulling device, and the gliding piece 3 moves smoothly.

Figure 1:
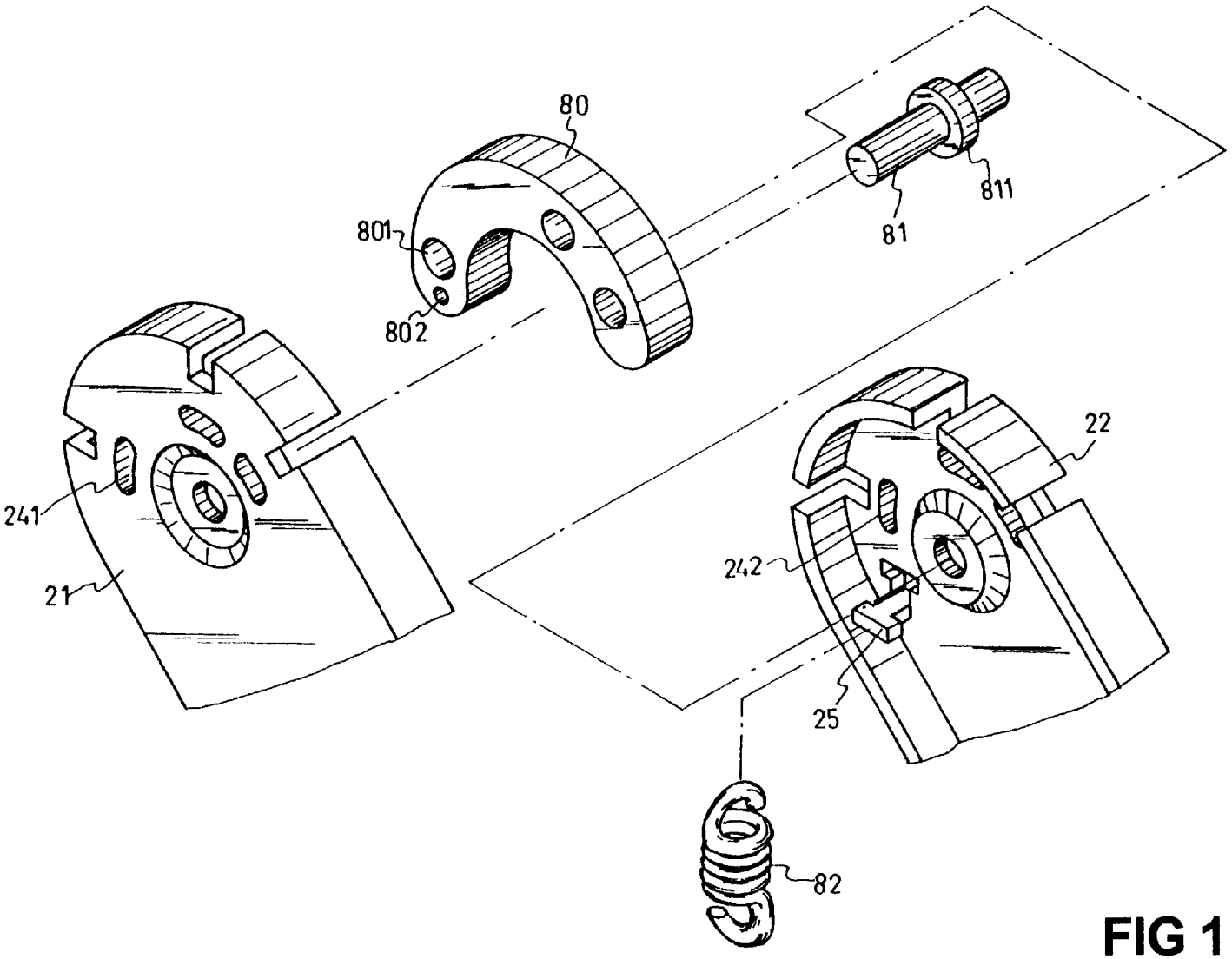
FIG. 1 is a perspective view of the pulling device for a foldable ladder joint of the present invention in the first embodiment.
Figure 2:
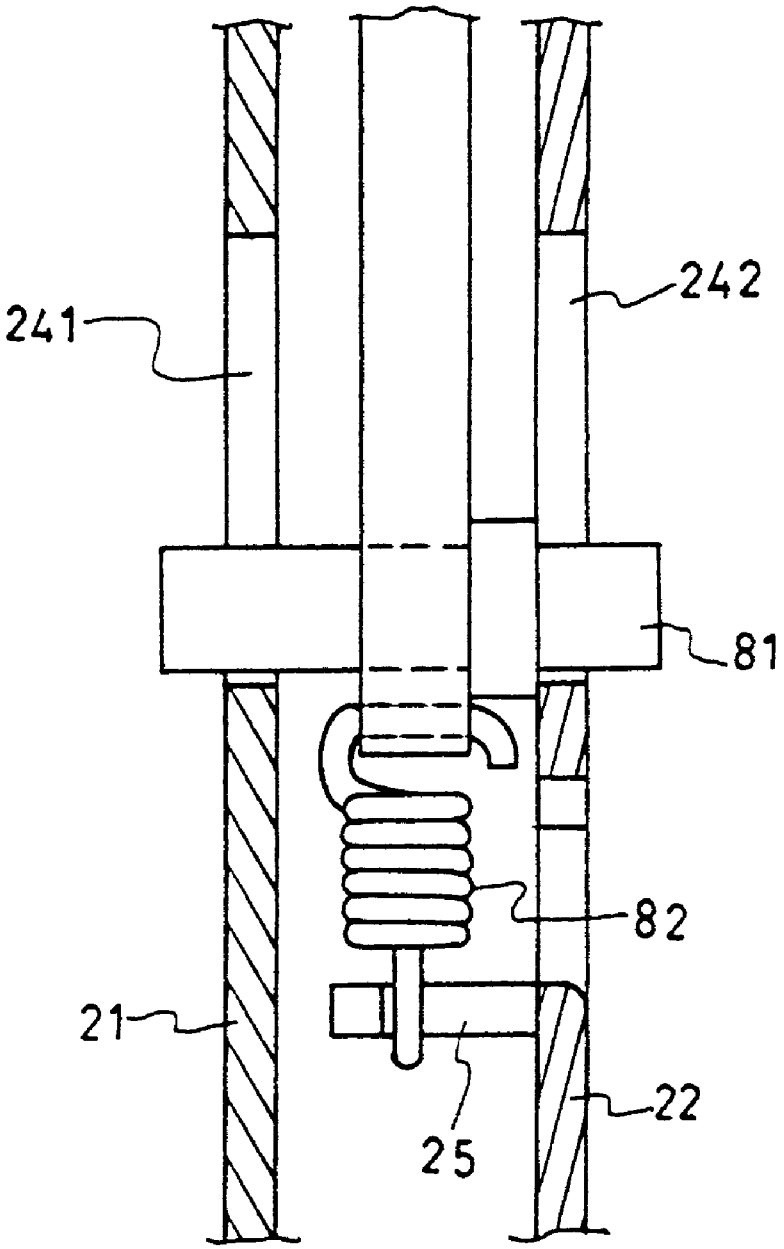
FIG. 2 is a partial sectional view of the pulling device for a foldable ladder joint of the present invention in the first embodiment.

Referring to FIGS. 1 and 2, the pulling device for a foldable ladder joint of the present invention in a first embodiment comprises: an arc-shaped part 80, three gliding pins 81, each gliding pin 81 having a middle section 811, which "has a size greater than the remaining part of the gliding pin 81". a spring 82 with two ends; an inner body 21 with three arc-shaped holes 241; and an inner body 22 with three arc-shaped holes 242 and a holding projection 25. The arc-shaped part 80 and the arc-shaped holes 241, 242 extend along aligned circular lines of equal diameters, with the arc-shaped holes 241, 242 having equal widths perpendicular thereto. The inner bodies 21, 22 enclose the arc-shaped body 80. The arc-shaped body 80 has a width, which is smaller than the distance between the inner bodies 21, 22, and is therefore glidingly movable between the inner bodies 21, 22. Furthermore, the arc-shaped body 80 has three holes 801, which are respectively aligned with the arcshaped holes 241 and the arc-shaped holes 242 and passed through by the gliding pins 81. The holes 801 have diameters, which are equal to the widths of the arc-shaped holes 241, 242. The arc-shaped part 80 has a holding end close to the holding projection 25. A small hole 802 is bored through the holding end for holding one of the two ends of the spring 82, while the other end thereof is held by the holding projection 25. A characteristic of the present invention in the first embodiment thereof is the middle sections 811 of the gliding pins 81. The gliding pins 81 pass through the inner body 21, the arc-shaped part 80 and the inner body 22, with the middle sections 811 separating the inner body 22 from the arc-shaped part 80 and leaning against the arc-shaped part 80.

Operating the handle 7 causes the handle 7 to press against one of the gliding pieces 81, as shown in FIG. 5, and to move the arc-shaped part 80 along the circular path thereof, with the arc-shaped holes 241, 242 guiding the gliding pins 81. At this time, the spring 82 exerts an elastic force on the arc-shaped body 80 and thus on the handle 7.

Figure 3:
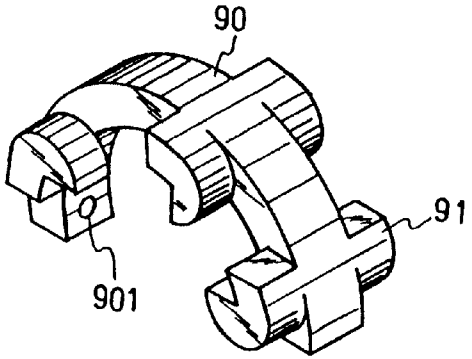
FIG. 3 is a perspective view of the arc-shaped part of the present invention in the second embodiment.
Figure 4:
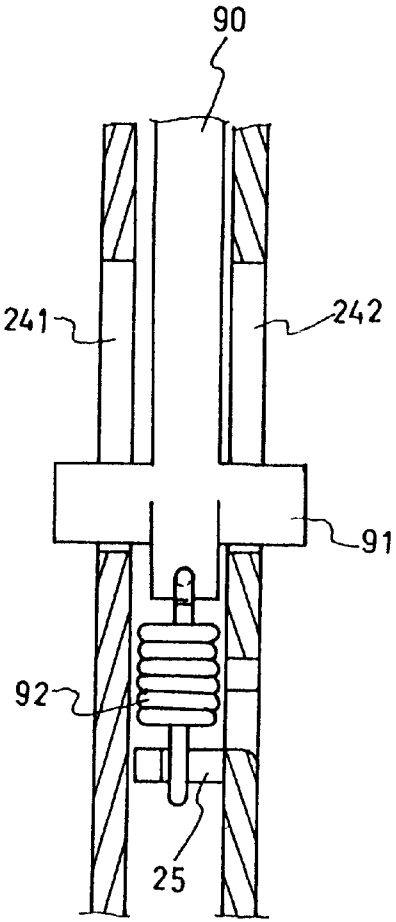
FIG. 4 is a partial sectional view of the pulling device for a foldable ladder joint of the present invention in the second embodiment.

Referring to FIGS. 3 and 4, the pulling device for a foldable ladder joint of the present invention in a second embodiment has an arc-shaped part 90 along a circular path and a spring 92 for pulling the arc-shaped part 90 along the circular path. The arc-shaped part 90 has three two-sided projections 91 towards the inner bodies 21 and 22. Each of the three two-sided projections 91 extends into one of the arc-shaped holes 241 of the inner body 21 and one of the arc-shaped holes 242 of the inner body 22. The projections 91 have diameters, which are equal to the widths of the arc-shaped holes 241, 242. The arc-shaped part 90 has a holding end close to the holding projection 25. A small hole 902 is bored through the holding end for holding one of the two ends of the spring 92, while the other end thereof is held by the holding projection 25. Operating the handle 7 causes the handle 7 to press against one of the projections 91, as shown in FIG. 5, and to move the arc-shaped part 90 along the circular path thereof, with the arc-shaped holes 241, 242 guiding the projections 91.

I claim:

1. A pulling device for a foldable ladder joint, comprising:

two inner bodies, each having a front surface with a set of three arc-shaped holes, said holes being positioned on and extended along a circular path, with said front surfaces facing each other, such that said sets of three arc-shaped holes are aligned, one of said inner bodies further having a holding projection positioned on said circular path;

an arc-shaped part, glidingly inserted between said two inner bodies, said part having one holding end which is close to said holding projection, said part having three two-sided projections, each of said three two-sided projections extending towards both of said inner bodies into one hole of both of said sets of three arc-shaped holes, said holding end having a through hole; and a spring with a first end and a second end, said first end being held by said holding projection and said second end being held by said through hole of said holding end.

2. A pulling device for a foldable ladder joint, comprising two inner bodies, each having a front surface with a set of three arc-shaped holes, said holes being positioned on and extended along a common circular path, with said front surfaces facing each other, such that said sets of three arc-shaped holes are aligned, one of said inner bodies further having a holding projection positioned on said circular path;

an arc-shaped part, glidingly inserted between said two inner bodies, said part having one holding end which is close to said holding projection, said part having three holes which are aligned with said two sets of three arc-shaped holes of said inner bodies, said holding end having a through hole;

three gliding pins, each gliding pin passing through one of said holes on said arc-shaped part and through one hole of both of said sets of three arc-shaped holes on said inner bodies and each gliding pin having a middle section which leans against said arc-shaped part; and a spring with a first end and a second end, said first end being held by said holding projection and said second end being held by said through hole on said holding end.

* * * * *